US007585441B2

(12) United States Patent
Caenen et al.

(10) Patent No.: US 7,585,441 B2
(45) **Date of Patent: *Sep. 8, 2009**

(54) PROCESS OF MAKING CELLULOSE ACETATE TOW

(75) Inventors: Philip I. L. Caenen, Lanaken (BE); William S. Sanderson, Blacksburg, VA (US)

(73) Assignee: Celanese Acetate, LLC, Dallas, TX (US)

( * ) Notice: Subject to any disclaimer, the term of this patent is extended or adjusted under 35 U.S.C. 154(b) by 857 days.

This patent is subject to a terminal disclaimer.

(21) Appl. No.: 10/877,799

(22) Filed: Jun. 25, 2004

(65) Prior Publication Data

US 2005/0288163 A1 Dec. 29, 2005

(51) Int. Cl.
*D01D 5/22* (2006.01)
*D01F 2/28* (2006.01)
*D02G 1/12* (2006.01)

(52) U.S. Cl. ..... 264/103; 264/130; 264/168; 264/178 F; 264/187; 264/207; 264/211.12; 264/211.14; 264/234

(58) Field of Classification Search ..... 264/103, 264/130, 168, 178 F, 187, 207, 211.12, 211.14, 264/234

See application file for complete search history.

(56) References Cited

U.S. PATENT DOCUMENTS

| | | | | |
|---|---|---|---|---|
| 3,120,692 | A * | 2/1964 | Crawford et al. | 264/168 |
| 3,305,897 | A | 2/1967 | Meibohm | |
| 3,353,239 | A | 11/1967 | Heijnis | |
| 3,571,870 | A * | 3/1971 | Dixon et al. | 28/265 |
| 4,361,493 | A * | 11/1982 | Kiefer | 252/184 |
| 4,503,593 | A | 3/1985 | Floyd et al. | |
| 4,850,301 | A * | 7/1989 | Greene et al. | 118/255 |
| 5,020,198 | A | 6/1991 | Hill et al. | |
| 5,225,277 | A | 7/1993 | Takegawa et al. | |
| 5,246,017 | A | 9/1993 | Saintsing et al. | |
| 5,427,852 | A * | 6/1995 | Teufel et al. | 428/357 |
| 5,591,388 | A | 1/1997 | Sellars et al. | |
| 5,618,620 | A | 4/1997 | Takegawa et al. | |

FOREIGN PATENT DOCUMENTS

| | | | |
|---|---|---|---|
| JP | 56-53223 | | 5/1981 |
| JP | 2964191 | | 7/1993 |
| WO | WO-99/59436 | A1 * | 11/1999 |
| WO | WO 02/087366 | A2 | 11/2002 |
| WO | WO 2005/084466 | A1 | 9/2005 |

* cited by examiner

*Primary Examiner*—Leo B Tentoni
(74) *Attorney, Agent, or Firm*—Hammer & Associates, P.C.

(57) ABSTRACT

In the manufacture of a fiber tow, particularly cellulose acetate tow, the tow is plasticized prior to entry into the crimper. The preferred plasticizer is water.

13 Claims, 7 Drawing Sheets

PROCESS OF MAKING CELLULOSE ACETATE TOW

FIELD OF THE INVENTION

The present invention is directed to cellulose acetate tow and a method of making the same.

BACKGROUND OF THE INVENTION

Cellulose acetate tow producers market uniform pressure drop (PD) to cigarette filter producers. Tow, however, is sold by weight. The relationship between PD and weight is referred to as yield (PD/weight). Yield is often illustrated by a line on a graph where the x-axis is the weight and the y-axis is the PD. The lowermost end of the yield line is defined as the point at which the rod develops recessed ends and the uppermost end of the yield line is defined as the point at which the rod splits or machine roll wraps occur because of too much tow. Browne, C. L., *The Design of Cigarettes*, Hoechst Celanese Corporation, 1990, page 66.

The cigarette filter is a very complex device and many factors effect its production and performance. As with all complex devices, these factors are often interrelated, so that changes in one factor have effects on other factors. Several factors, specifically addressed herein, include firmness, pressure drop, PD variability, fly, and openability. These qualities are considered by a filter producer when comparing tow suppliers. Firmness, a rod quality, refers to the deformation of a filter rod under a specified load for a specified contact time. The load cell weight and contact time is dependent on the instrument used. Firmness is generally expressed as the percentage of diameter retained (i.e., a higher percentage is more desirable). PD variability, a rod quality, refers to the PD uniformity of a large number of rods and is quantified by a Cv (coefficient of variation). Filter producers want the lowest possible Cv to achieve minimum variability in the delivery of cigarette smoke components. Fly, also called "lint", a tow quality, is not often quantified, but is readily apparent to the filter producer while removing tow from the bale or on the rod-making machine, and can be a significant source of defective filter rods (lumps of fiber, wormholes) as well as a cause for more frequent cleaning the opening and rodmaking machinery. Openability, a tow quality, refers to the ease of opening in the rodmaking equipment to completely deregister, or "bloom", the tow, and is seldom quantified, but is readily apparent to the filter producer.

Obviously, the filter producer wants a tow product that provides a rod that possesses the desired firmness and low PD variability, opens easily, and has no fly. With the current state-of-the-art, such a product is not available. Moreover, the route to producing this product is not clear due to the complexities associated with the production of cigarette filters and cigarette filter tow.

One skilled in the art knows that firmness, pressure drop, PD variability, fly, and openability can be influenced by tow crimp. Crimp is a waviness imparted to synthetic fibers during manufacture and crimp level may be measured as uncrimping energy (UCE). One skilled in the art recognizes that influencing crimp to improve one quality often causes another quality to suffer. For example, increasing UCE increases fly (bad), and decreases PD variability (good), and inhibits openability (bad), other process conditions generally remaining unchanged.

Products with extremely high crimp have been produced, but are not problem free. For example, Rhodia Acetow® produces a product under the tradename Rhodia SK®. Rhodia SK® is a high yield tow (meaning high PD for low weight) and achieves that result with high crimp. But, Rhodia SK also has greater than normal fly and is difficult to open at conditions typical for conventional tow. This follows the conventional wisdom. The difficulty associated with opening is seen by the requirement to change from conventional rodmaking settings, i.e., increased work must be applied to the tow to completely deregister, or "bloom", the tow which may be accomplished by changes in the threaded roll design, the threaded roll pressure, and/or the ratio of roll speed on the rodmaker. This increased work results in additional fly due to fiber breakage.

Accordingly, the problem is how to produce a tow product that opens easily and provides a filter rod with the desired firmness, low PD variability, and low fly. Based upon the prior art, such a product cannot be obtained solely by a high crimp tow.

U.S. Pat. No. 3,353,239 discloses a stuffer box crimper where the nip rollers have circumferential grooves.

Japanese Patent No. 2964191 (based on Japanese Application No. 1991-358234 filed Dec. 27, 1991) is directed to a stuffer box crimper for cigarette tow production. This patent teaches that lubricating the edges of the tow prior to crimping with a lubricant (i.e., water) at a feed rate of 25-50 cc/min will reduce fly.

U.S. Pat. No. 3,305,897 discloses steam crimping of polyester tow in a stuffer box crimper. Steam at 20-40 psig is introduced into the stuffer chamber. U.S. Pat. Nos. 5,225,277 and 5,618,620 disclose heat-treating the tow with steam upstream of the crimper or while the tow is in the crimper. Japanese Application No. 54-127861 discloses heat treatment of tow upstream of the crimper. U.S. Pat. No. 5,591,388 discloses a process for producing crimped lyocell (solvent-spun cellulose) using slightly superheated (dry) steam injected onto the fibers as they are crimped in the stuffer box of a crimper. The superheated steam is at a pressure of 5 psi to 70 psi or greater.

WIPO Publication No. WO 02-087366 illustrates that increasing crimp levels also increases the fly (fluff) of the tow. Note Examples.

SUMMARY OF THE INVENTION

In the manufacture of a fiber tow, particularly cellulose acetate tow, the tow is plasticized prior to entry into the crimper. The preferred plasticizer is water.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

In general, cigarette tow is made by spinning a dope into a plurality of filaments, taking up the filaments, lubricating the filaments, forming a tow by bundling a plurality of the filaments, crimping the tow, drying the crimped tow, and baling the dried crimped tow. In the present invention, each of these steps is conventional unless discussed below.

A dope is a solution of the polymer and solvent. The preferred polymer is cellulose acetate and the preferred solvent is acetone. Cellulose acetate suitable for use as cigarette filter material typically has a degree of substitution of less than 3.0, preferably in the range of 2.2 to 2.8, and most preferably in the range of 2.4 to 2.6.

The filaments typically range from 1 to 10 denier per filament (dpf). The filaments may have any cross-sectional shape, including, but not limited to, circular, crenulated, Y, X, and dogbone. The tow ranges from 10,000 to 100,000 total denier. The tow has a width (lateral edge to lateral edge) of less than 3 inches (8 cm) exiting the crimper.

Figure 1:
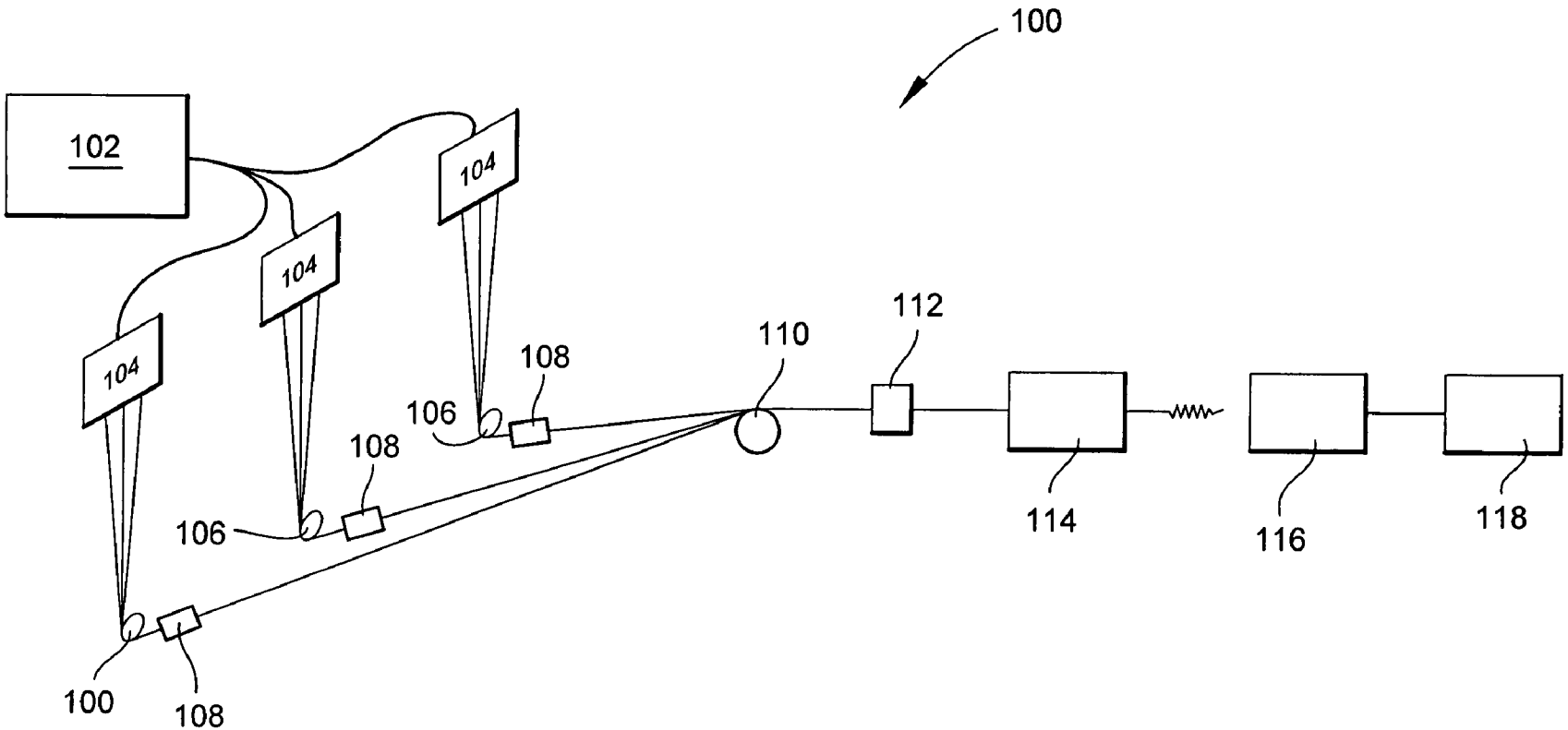
FIG. 1 is a schematic illustration of a cigarette tow production process according to the present invention.

Referring to FIG. 1, cigarette tow process 100 is shown. Dope preparation station 102 feeds a plurality of cabinets 104 (only three shown, but not necessarily so limited). In cabinets 104, fibers are produced, in a conventional manner. The fibers are taken-up on take-up roller 106. These fibers are lubricated at a lubrication station 108 with a finish (discussed in greater detail below). These lubricated fibers are bundled together to form a tow on a roller 110. The tow is plasticized at a plasticizing station 112 (discussed in greater detail below). The tow is then passed through a crimper 114 (discussed in greater detail below). The crimped tow is dried in dryer 116. The dried crimped tow is then baled at baling station 118.

In general, filter rods for cigarettes are made by de-baling and opening the tow, and running the open tow through a conventional rodmaking machine, such as the Hauni AF-KDF-2E or AF-KDF-4, commercially available from Hauni of Hamburg, Germany. In the rodmaker, the tow is opened or "bloomed", formed into a rod, and wrapped with paper, referred to as plugwrap. The filter rod is subsequently cut to a specified length and attached to a cigarette. In the present invention, the rodmaking techniques are conventional.

While the instant invention is directed primarily to cigarette tow, the invention may also be used in the production of any spinnable polymer. Such spinnable polymers include, but are not limited to, polyolefins, polyamides, polyesters, cellulose esters and ethers and their derivatives, polylactic acid (PLA), and the like.

The lubricant (or finish) applied to the fibers at the first lubrication station 108 comprises: mineral oil, emulsifiers, and water. The mineral oil is a liquid petroleum derivative. The preferred mineral oil is a water white (i.e., clear) mineral oil having a viscosity of 80-95 SUS (Sabolt Universal Seconds) measured at 100° F. The emulsifiers are preferably a mixture of emulsifiers. The preferred mixture consists sorbitan monolaurate (SPAN 20 from, for example, Uniqema of Wilmington, Del.) and POE 20 sorbitan monolaurate (TWEEN 20 from, for example, Uniqema of Wilmington, Del.). The water is preferably de-mineralized water, de-ionized water, or otherwise appropriately filtered and treated water. The lubricant may consist of (% expressed as weight %): 62.0-65.0% mineral oil, 27.0-28.0% emulsifiers, and 8.0-10.0% water; preferably, 63.5-64.0% mineral oil, 27.5-28.0% emulsifier, 8.3-8.5% water; and most preferably, 63.6% mineral oil, 28.0% emulsifier, and 8.4% water. The emulsifier mixture consists of (% expressed as weight %, it being understood that some water is included in these materials but is not included herein): 50.0-52.0% sorbitan monolaurate and 48.0-50.0 POE (20) sorbitan monolaurate; 50.5-51.5% sorbitan monolaurate and 48.5-49.5% POE (20) sorbitan monolaurate; and most preferably, 50.9-51.4% sorbitan monolaurate and 49.6-49.1% POE (20) sorbitan monolaurate. The lubricant is then mixed with water (e.g., de-ionized or de-mineralized water) to form a 3-15% water emulsion. The water emulsion is added on to the tow to obtain a final range from 0.7-1.8% FOY (i.e., after the dryer), preferably about 1.0% FOY (FOY is finish on yarn and represents the lubricant less added water).

After the fibers are bundled into a tow and before the tow enters the crimper, the tow is plasticized at the plasticizing station 112. The plasticizing station 112 is adjustable up and down and from side to side, so that the tow properly enters crimper 114 as will be more apparent in the discussion of the crimper below. The plasticizing station 112 is spaced away from crimper 114. Plasticizing station 112 is placed before the crimper 114, so that the plasticizer added to the tow has a sufficient time to plasticize the tow. Preferably, plasticizer station 112 is at least one half (½) meter before the crimper nip, more preferably one meter before the crimper nip. The plasticizer station 112 adds a plasticizer, preferably water, most preferably de-mineralized water, to the tow. The plasticizer is applied at a maximum rate to a point of excess spray-back from the crimper nip rolls. The application rate is preferably less than 300 cc/min at line speeds of 200-1,000 meters per minute with a tow of 10,000-100,000 total denier, most preferably 25-200 cc/min at line speeds of 200-1,000 meters per minute with a tow of 10,000-100,000 total denier. The applicator is preferably a "spool" type guide(s) adapted to deliver the plasticizer. Preferably, a pair of spool guides is used to insure proper wetting of both sides of the tow. The spool guides may be spaced apart so that the tow runs therebetween in a straight line or the spool guides may be closely spaced so that the tow runs therebetween in an "S" shaped path. The surface of the spool guides may be flat or curved (e.g., concave, convex, wavy, or concaved/convexed). The spool guide may be made of ceramic material or ceramic coated. The spool guide may be flanged or flangeless. The spool guide may have a plurality of openings through which the plasticizer is applied to the tow.

Figure 2:
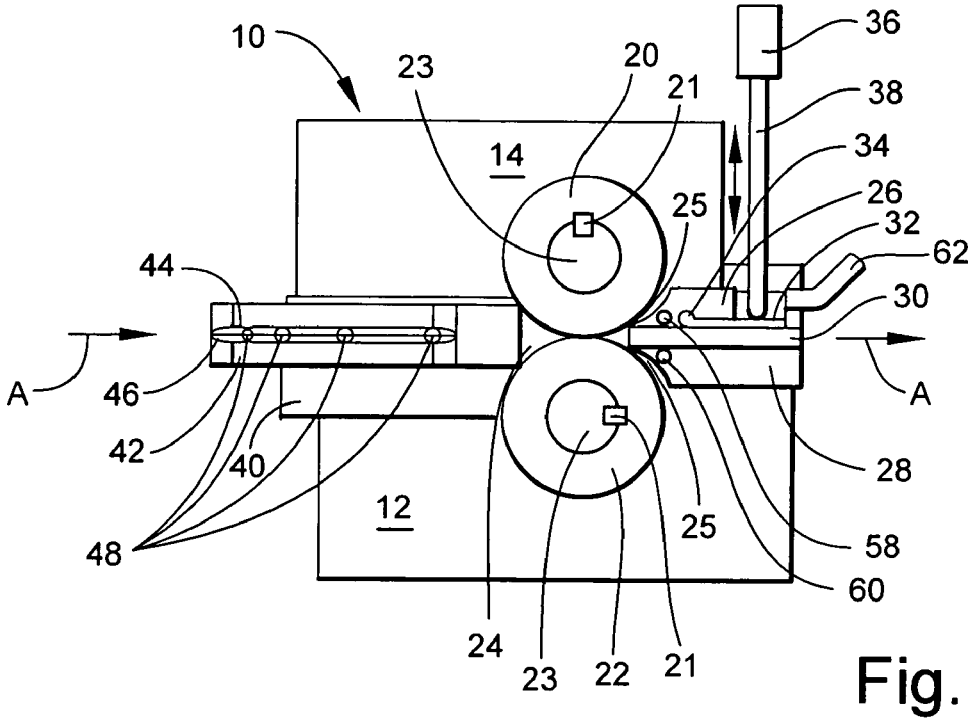
FIG. 2 is a side elevational view of a stuffer box crimper made according to the present invention, parts broken away for clarity.

In FIG. 2, there is shown a stuffer box crimper 10 made according to the present invention. Crimper 10 has a base frame 12 and a top frame 14. Base frame 12 and top frame 14 are joined together in a conventional manner, so that top frame 14 may move (or "float") in relation to base frame 12. The tow travels through the crimper as indicated by arrows A.

In general, tow, not shown, is pulled through the crimper 10 by a pair of driven nip rollers 20, 22 (discussed in greater detail below) that are mounted on shafts 23 and fixed in place via keys 21. Upper nip roller 20 is mounted on the top frame 14. Lower nip roller 22 is mounted on base frame 12. Shafts 23 are coupled to motors (not shown). The tow leaves the nip rollers 20, 22 and enters the stuffer box (discussed in greater detail below) having a channel 30 and a flapper 32 located at the distal end of the channel 30. In the channel 30, the tow is folded perpendicular to its direction of travel as it encounters backpressure caused by the tow being shoved (or stuffed) into the channel 30 against the flapper 32. This folding creates the crimp in the tow.

Nip rolls 20, 22, in the present invention, are referred to as "induced crimp" rolls. The induced crimp rolls crease (or bend) the tow as it passes through the nip and thereby "trains" the tow where to crimp (e.g., influences the location of crimp in the tow by preferentially weakening areas of the tow to be crimped). The result is a more uniformly crimped tow. More uniformly means, in one respect, that the peaks of the crimped tow (assuming that the crimped tow has a generally saw-toothed shape from an elevational perspective) are parallel to one another (when viewed from a top plan perspective); without the induced crimp rolls, the peaks of the crimped tow are more randomly oriented (not uniformly parallel) with respect to one another. While in the present invention it is preferred that the induced crimp rolls be the nip rolls of the crimper, the invention is not so limited. The induced crimp rolls may be another pair of rollers located before the crimper 10. Also, the induced crimp rolls grip the tow thereby preventing slippage.

Either or both nip rolls may be an "induced crimp roll". One nip roll may have a smooth circumferential surface and the other may have an axially grooved circumferential surface, or both rolls may have an axially grooved circumferential surface. The axially grooved roll creases the tow and thereby trains it to crimp in a uniform manner. The grooved roll may be located either on the top or bottom of the pair, but it is preferred at the bottom.

The term "grooved" refers to any surface texturing that will "induce" crimp. Such surface texturing may include grooves, dimples, or other types of texturing. A surface having grooves is preferred. The grooves are preferably in the form of a sine curve, but may also be rectangular, triangular, or semicircular notches, grooves, or ridges with or without flat surfaces therebetween that extend axially (i.e., lateral to lateral) across the face of the roller. These grooves may range from 10 to 100 grooves per inch (2.5 cm), preferably 25 to 75 grooves per inch (2.5 cm), most preferably 50 grooves per inch (2.5 cm). The groove depth (peak to trough) may range from 0.5 mils to 5.0 mils (12.5 micron to 150 microns), preferably 1-2 mils (25-50 microns).

Upper nip roll 20, the smooth roll, may be made of metallic or ceramic materials. Those materials include, but are not limited to, steel/alloy bonded titanium carbides, tungsten carbides, hipped or unhipped MgO stabilized zirconia, or hipped or unhipped Yttria stabilized zirconia (YTZP). (Hipped refers to hot isostatic pressing.) The zirconias are preferred. The hipped Yttria stabilized zirconia is most preferred because it exhibits the best wear life and chip resistance. The surface finish (texture) is preferably no greater than 16 rms, with sharp lateral edges and free of chips.

Lower nip roll 22, the axially grooved roll, may be made of metallic or ceramic materials. Those materials include, but are not limited to, steel/alloy bonded titanium carbides, tungsten carbides, hipped or unhipped MgO stabilized zirconia, or hipped or unhipped Yttria stabilized zirconia (YTZP). The zirconias are preferred. The hipped Yttria stabilized zirconia is most preferred because it exhibited the best wear life and most chip resistant. The surface finish (texture) is preferably no greater than 12 rms, with sharp lateral edges, rounded groove edges, and free of chips.

In an alternate embodiment of the invention, nip rolls 20, 22 are not the "induced crimp" rolls mentioned above (i.e., no axial grooves on either roll 20, 22). In this embodiment, the nip rolls 20, 22 are made of solid ceramic materials. This means that the roll is ceramic (i.e., not merely a coating). The ceramic materials include unhipped or hipped MgO stabilized zirconia, or hipped or unhipped Yttria stabilized zirconia (YTZP). The zirconias are preferred. The hipped Yttria stabilized zirconia is most preferred because it exhibits the best wear life and chip resistance. The surface finish (texture) is preferably no greater than 16 rms, with sharp lateral edges and free of chips.

Cheek plates 24 (FIG. 3) are located on both lateral sides of the nip rollers 20, 22 and abut the doctor blades 25. The cheek plates 24 are used to keep the tow in the nip between the nip rollers 20, 22. The cheek plates 24 may be made of metal, ceramic, or ceramic coated metal. Preferably, the cheek plates are an alumina ceramic for good wear resistance and lower friction.

The stuffer box has an upper half 26 affixed to the top frame 14 and a lower half 28 affixed to the base frame 12. The halves when mated define a stuffer box channel 30. A flapper 32 is located in the distal end of the channel. Flapper 32 is preferably mounted to upper half 26 via a pivot 34, so that flapper 32 may swing into channel 30 and partially close same. Movement of flapper 32 may be controlled by an actuator 36 that is operatively coupled to flapper 32 via rod 38. Flapper 32 movement is preferably controlled to insure uniformity of the crimp by any conventional means including, but not limited to weight, or pneumatic, or electrical, or electronic means.

Doctor blades 25 are preferably an integral part of the upper half 26 and lower half 28 of the stuffer box. Doctor blades 25 are located next to (e.g., with a clearance of about 1 mil (25 microns)) the nip rolls 20, 22, so that tow does not stick to the rolls and is directed into channel 30.

A steam injector 58 is located in the upper half 26 of the stuffer box. Steam injector 58 is positioned as close to the end of the doctor blade 25 adjacent the nip roll 20 as practically possible. Steam injector 58 is located between flapper 32 and the end of the doctor blade 25 adjacent to the nip roll 20. Steam injector 58 is in communication with stuffer box channel 30. Steam injector 58 allows steam to set and lightly bond the crimp of the tow in channel 30. Steam injector 58 may possess any type of suitable openings, such as a single or multiple slots or single or multiple holes. Steam injector 58 is preferably a plurality of circular holes spanning the width of the channel 30, so that steam is distributed uniformly across the width of the tow in the channel 30. The steam (delivered into the channel) is preferably low-pressure steam at 100° C. The steam is most preferably a low-pressure dry steam at 100° C. The steam pressure is in the range of 0.01 to 5 psig. Preferably, the steam is filtered, through a 2 micron filter, to remove particulates from the steam and the steam is fed from the filter to the injector through stainless steel tubing. The steam is preferably controlled by needle valves (other suitable valves may be used) located closely adjacent to the stuffer box. Preferably, there is a water trap between the valve and the stuffer box. The steam pressure will vary depending upon the size and the shape of the holes/slots of the steam injector 58. Steam is directed to injector 58 via steam inlet 62 which is a flexible coupling, so that upper half 26 of the stuffer box may float with top frame 14.

A steam injector 60 is located in the lower half 28 of the stuffer box. Steam injector 60 is positioned as close to the end of the doctor blade 25 adjacent the nip roll 22 as practically possible. Steam injector 60 is preferably located directly below injector 58 of the upper half 26 of the stuffer box. Steam injector 60 is in communication with stuffer box channel 30. Steam injector 60 allows steam to set and lightly bond the crimp of the tow in channel 30. Steam injector 60 may possess any type of suitable openings, such as a single or multiple slots or single or multiple holes. Steam injector 60 is preferably a plurality of circular holes spanning the width of the channel 30 (FIG. 3), so that steam is distributed uniformly across the width of the tow in the channel 30. The steam (delivered into the channel) is preferably low pressure steam at 100° C. The steam is most preferably a low pressure dry steam at 100° C. The steam pressure is in the range of 0.01 to 5 psig. Preferably, the steam is filtered, through a 2 micron filter, to remove particulates from the steam and the steam is fed from the filter to the injector through stainless steel tubing. The steam is preferably controlled by needle valves (other suitable valves may be used) located closely adjacent to the stuffer box. Preferably, there is a water trap between the valve and the stuffer box. The steam pressure will vary depending upon the size and the shape of the holes/slots of the steam injector 58. Steam is directed to injector 60 via steam inlet 64.

The total amount of steam injected into the stuffer box channel by the steam injectors 58/60 is in the range of 0.002-0.08 pounds of steam per pounds of tow, preferably 0.005-0.02 pounds of steam per pounds of tow.

Figure 3:
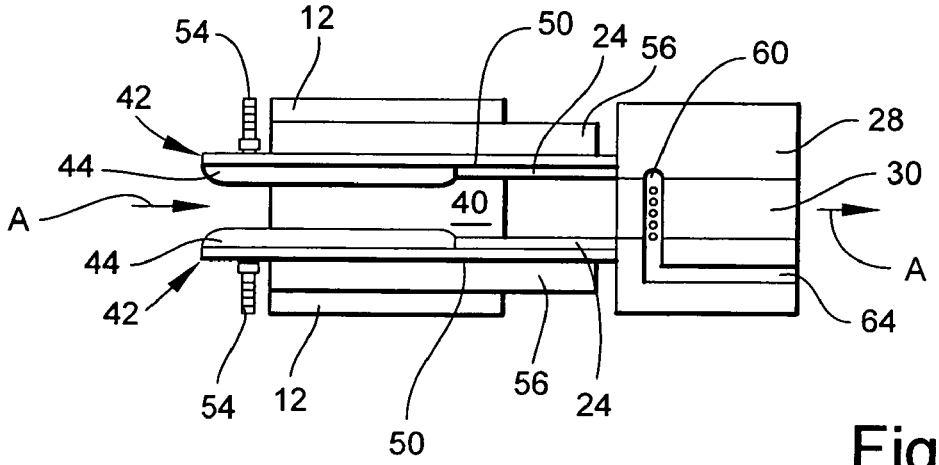
FIG. 3 is a top plan view of the stuffer box crimper in FIG. 2, parts broken away for clarity.
Figure 4:
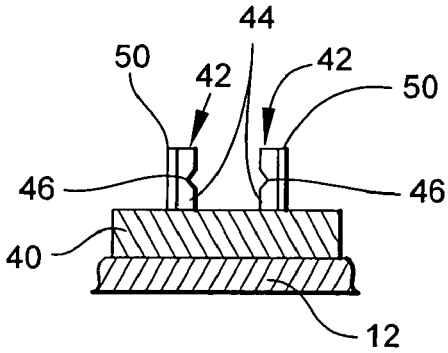
FIG. 4 is a front elevational detail view of the entry area of the stuffer box crimper in FIG. 2, parts broken away for clarity.

The edges of the tow are lubricated prior to entry into the stuffer box crimper 10. Lubrication is preferably added immediately prior to entry in to the stuffer box crimper 10. Lubrication is most preferably added to the tow edges immediately prior to the tow's entry into the nip between rolls 20, 22. This edge lubrication minimizes filament damage between the nip rolls and the cheeks plates. This edge lubricating system is mounted on an alignment base 40 which is attached to base frame 12. A fastening mechanism 56 (FIG. 3) allows the cheek plates 24 to be brought into position relative to the nip rolls 20, 22 in a conventional manner (i.e., with shims and/or wedges). In FIG. 4, two edge lubrication applicators 42 are shown securely mounted onto base 40, so that when the tow enters the crimper 10, the edges of the tow may be lubricated with a suitable lubricant, such as water.

Each edge lubrication applicator 42 comprises an applicator face 44 and backing plate 50. Backing plate 50 is sufficiently long to support (i.e., extend behind) both the applicator face 44 and cheek plate 24 (FIG. 3). Applicator face 44 is affixed to backing plate 50. The applicator face 44 is preferably flame spray ceramic coated to provide low friction and good wear. Cheek plate 24 is not affixed to plate 50, but instead is replaceably or removeably affixed. Applicator face 44 has a longitudinal groove 46. Tow edges are adapted to contact and run through the grooves 46 where they are lubricated. One or more orifices 48 (FIG. 2) are cut through applicator 42 and are in communication with grooves 46. The orifices 48 may be any number, size, or shape suitable to the task. The orifices 48 may be slots or circular holes. Preferably, the orifices 48 are round and of equal diameter. The diameter is optimized for best distribution, for example, preferably equal to the height of the tow. Inlets 54 supply the lubricant to applicators 42. The rate of lubricant addition via the applicator varies depending upon numerous factors, including but not limited to, tow speed, tow size (total denier), filament size (dpf), and cross-sectional shape to mention but a few. Lubricant is added to below a maximum rate, the maximum rate reached when either the tow line flutters or there is excessive sprayback from the crimper. Typically, the lubricant addition rate is less than 100 cc per minute per side, preferably less than 50 cc per minute per side, and most preferably between 10-50 cc/min/side.

The cigarette tow (i.e., that produced using the foregoing apparatus and processes) has a high uncrimping energy (UCE), a low fly, improved firmness, and is readily openable. Moreover, since the UCE has increased, the rod-to-rod pressure drop coefficient of variation (Cv) decreases.

Figure 5:
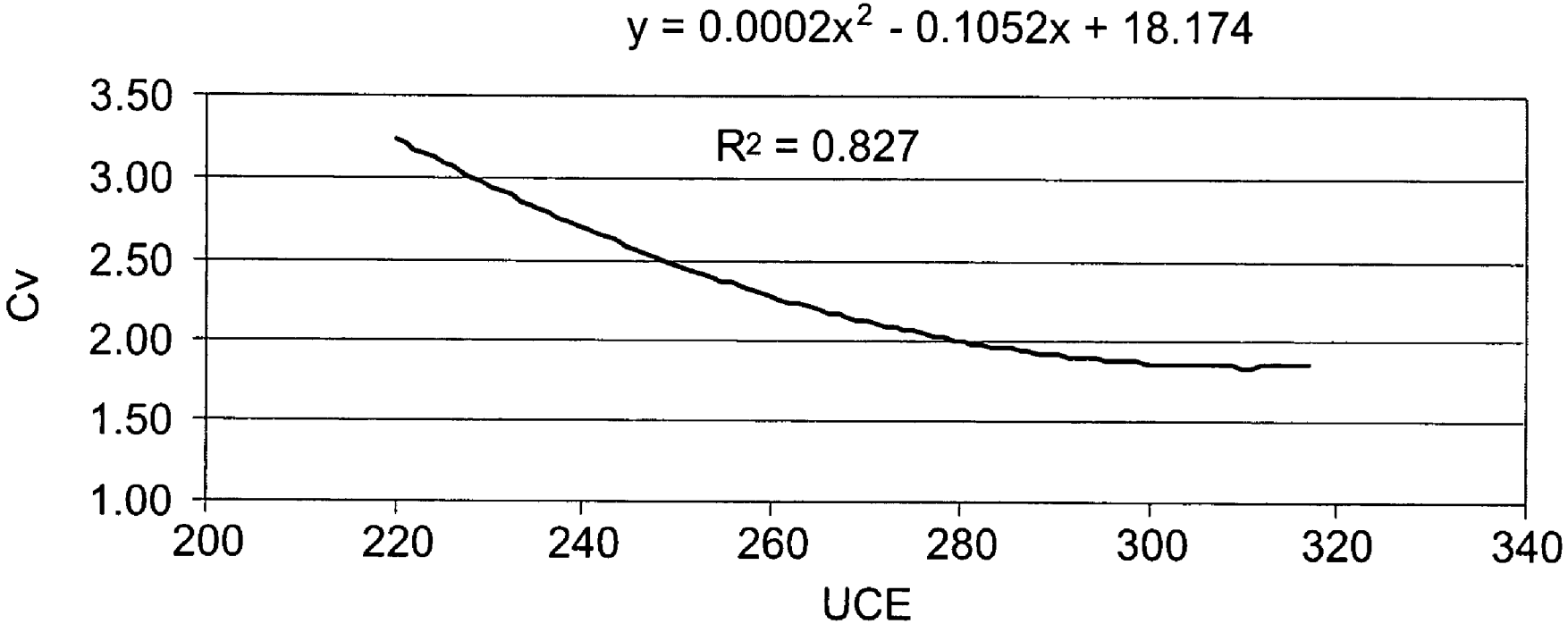
FIG. 5 is a graphical illustration showing the conventional relationship of UCE to the coefficient of variation (Cv) in the rod-to-rod pressure drop of filter rods.
Figure 6:
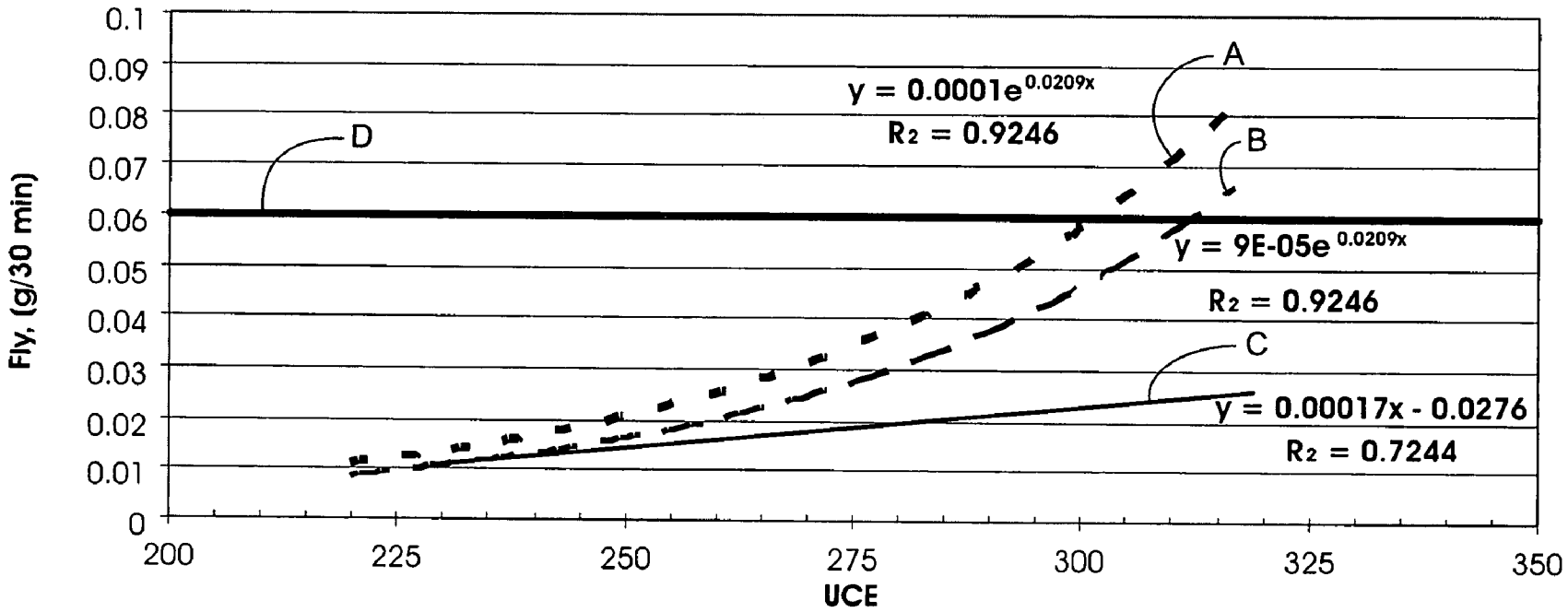
FIG. 6 is a graphical comparison of fly versus UCE for a conventional tow and an inventive tow.

Referring to FIG. 5, the conventional relationship between Cv and UCE is illustrated. It is known that as UCE increases, the Cv will decrease. Referring to FIG. 6, Curve A illustrates the conventional relationship between UCE and fly. Note that as the UCE increases, the fly rapidly increases. Because of the relationship expressed by curve A, tow producers have not been able to take full advantage of the relationship shown in FIG. 5. Line D represents an upper acceptable fly limit of 0.06 g/30 min.

On the other hand, curve B of FIG. 6 illustrates the inventive relationship between UCE and fly, i.e., high UCE and low fly. This relationship may be expressed as:

$$\text{Fly (g/30 min)}=0.00009e^{0.0209UCE}$$

Note that at equivalent UCE's, the inventive tow has a reduced fly. Curve C illustrates experimental results obtained (process discussed below). The experimental results may be expressed as:

$$\text{Fly (g/30 min)}=0.00017\text{UCE}-0.0276$$

Note that as UCE increase, the fly remains almost unchanged. Therefore, the tow producer is able to make a high UCE tow (that translates into a lower Cv tow) that has a low fly. Moreover, the inventive tow was openable like a conventional tow in spite of its higher UCE.

The tow represented by Curve C of FIG. 6 was made by a process having the induced crimp roller (discussed above) and the edge lubrication applicator 42 (discussed above), but it did not use the plasticizing station 112 or the steam injectors 58/60. The additional benefits of the steam injectors and the plasticizing station will be discussed below.

The steam injectors will have at least two benefits to the process and the product; first, it will further increase UCE, and second, it will increase rod firmness. Firmness, and to an extent the UCE increase, will result from increased final modulus of the tow. The firmness benefit will be discussed below.

Figure 7:
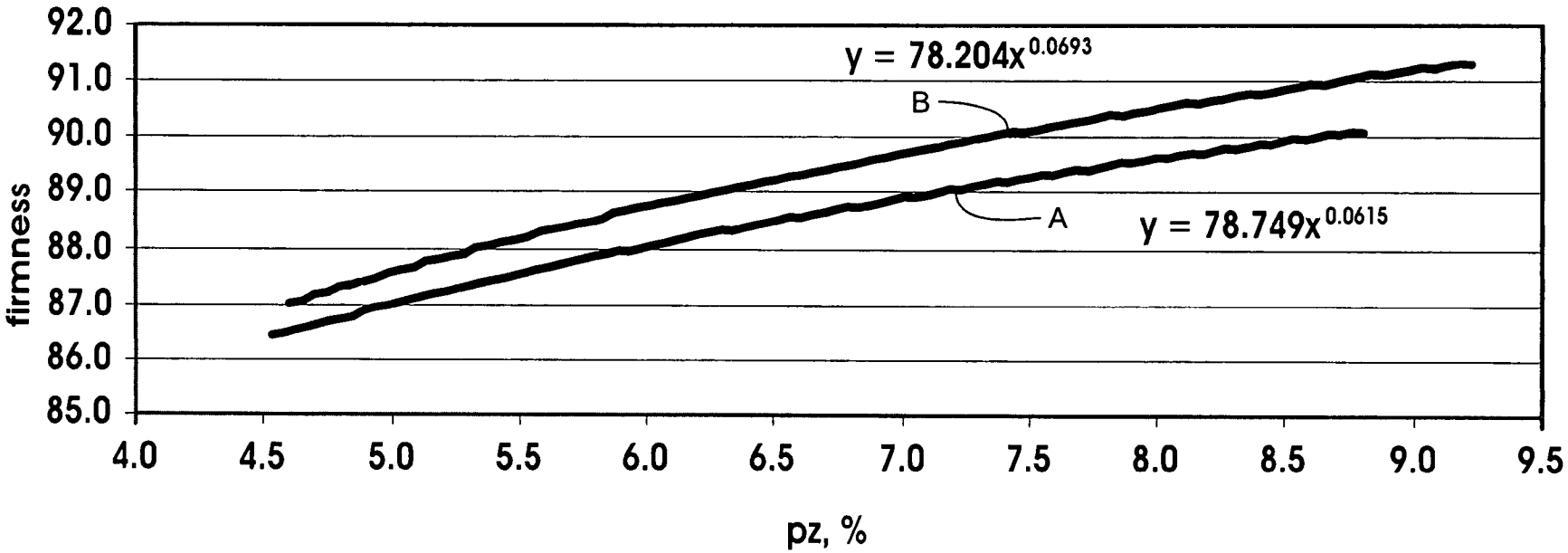
FIG. 7 is a graphical illustration of the relationship of firmness to filter rods made with varying amounts of plasticizer for tow made with and without stuffer box steaming.

Referring to FIG. 7, there is illustrated the relationship of firmness to the amount of plasticizer, pz %, (e.g., triacetin, etc., used for fiber bonding) added to a given rod. Curve A is a conventional tow; Curve B is an inventive tow that was steamed with 0.2 psig steam. The rod was a 108 mm long× 24.45 mm diameter, the only difference between Curve A and B was steaming, all else (e.g., tow, plugwrap, plasticizer (for fiber bonding), rodmaker and tester) was the same. The firmness test is discussed below. Note that with equivalent rods, firmness is improved by steaming and that increasing steam pressure will further increase the beneficial results. The effect of steaming enables at least a 0.5 firmness unit improvement to rod firmness.

The plasticizing station will have the benefit to the process and the product of allowing the moisture content of the tow to be increased. The benefit of increased tow moisture is discussed below.

Figure 8:
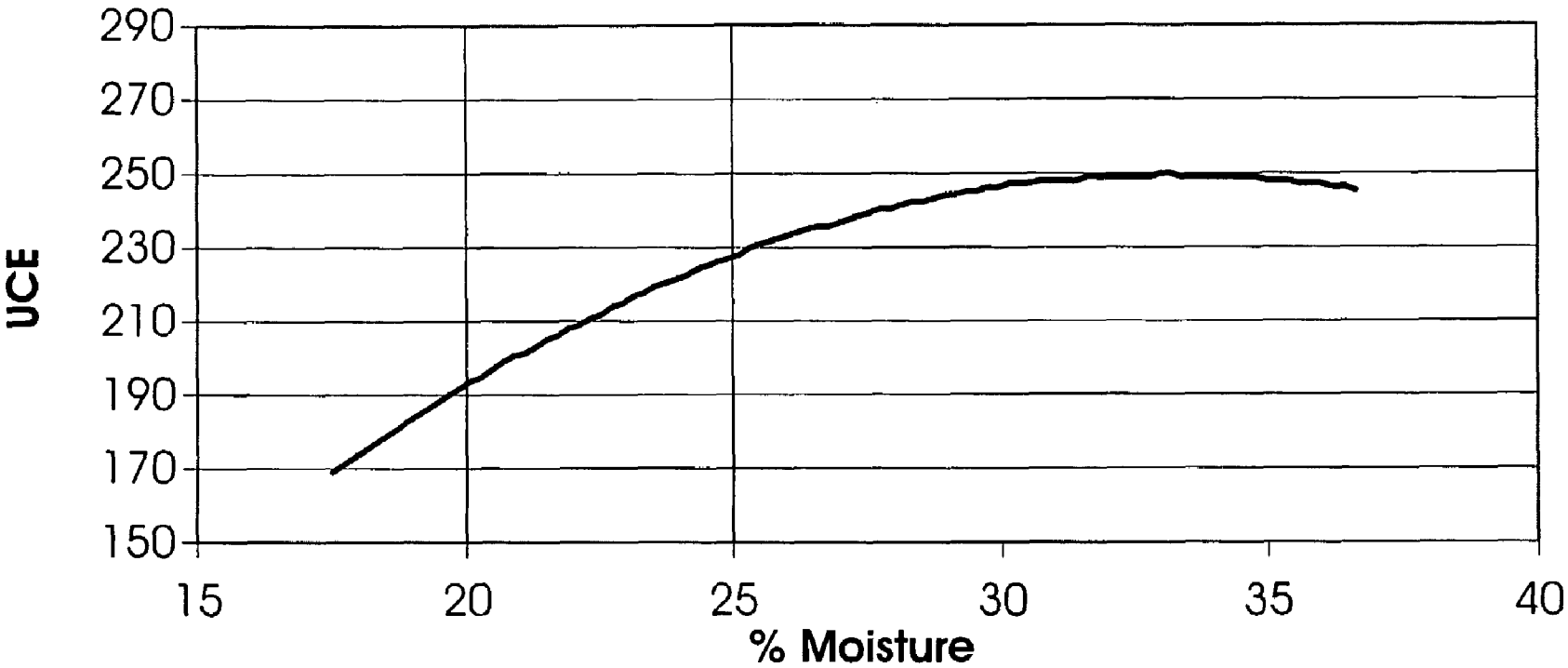
FIG. 8 is a graphical illustration of the conventional relationship of percent (%) total moisture of the tow (measured at the crimper exit) to UCE.
Figure 9:
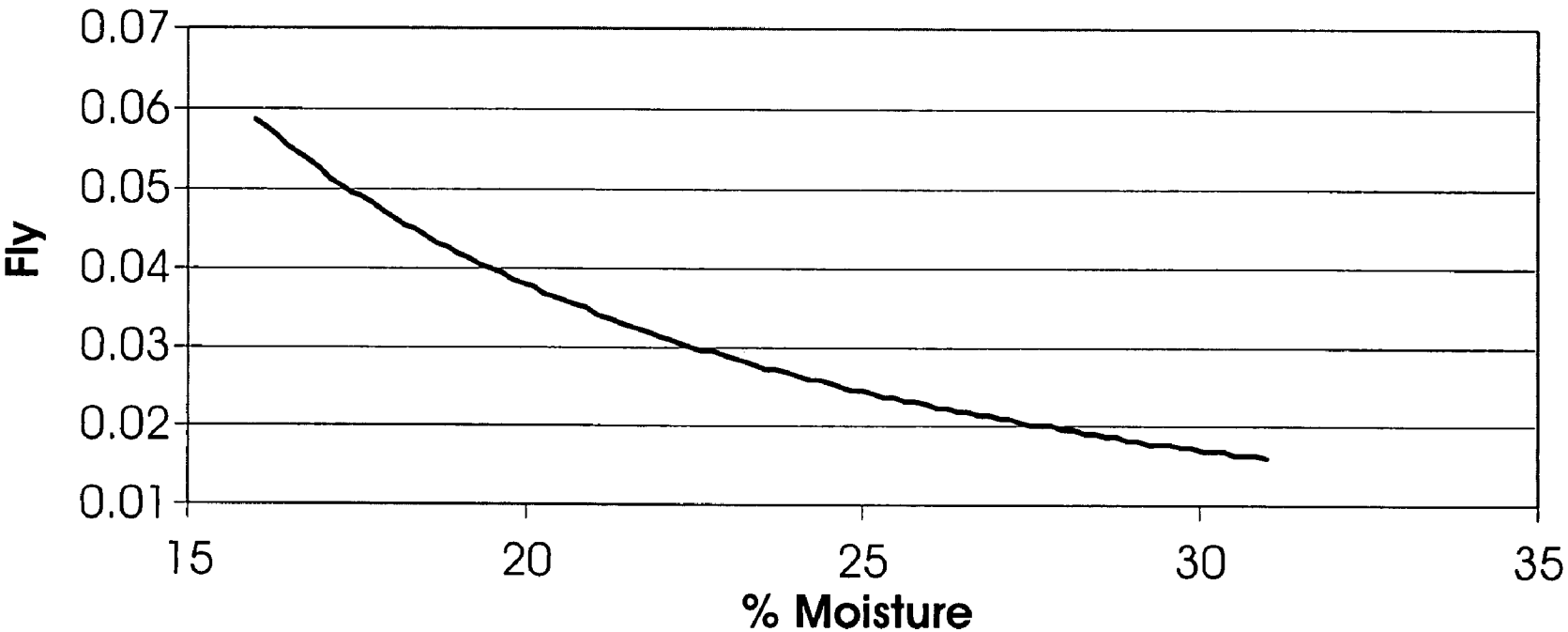
FIG. 9 is a graphical illustration of the inventive relationship of percent (%) total moisture of the tow (measured at the crimper exit) to fly.

Referring to FIG. 8, the conventional relationship between total moisture entering the crimper (measured at the crimper's exit) and UCE is shown. The UCE increases because the tow modulus is reduced and more crimp is imparted at given crimper settings. Further, as shown in FIG. 9, this increasing moisture also reduces fly. With the easier to crimp tow, less mechanical work is required to crimp, and hence, less tow damage is done.

Numerous process difficulties, however, make it impractical to increase moisture beyond the range (vertical lines at 20% and 25%) shown in FIG. 8. The plasticizing station solves this problem, and will provide the process and product benefit of reduced fly and more uniform time-wise crimp variation. The mechanism causing fly reduction with the edge water applicators of the crimper and with the plasticizing station are different and complimentary. The edge water applicators provide fiber protection by additional lubrication in a high pressure, abrasion area of the crimper, while the plasticizing station reduces the mechanical work to crimp and general fiber damage.

In a preferred embodiment, the tow has a UCE/fly relationship of:

$$\text{Fly (g/30 min)} < 0.00009e^{(0.0209UCE)}, \text{ up to the fly value of } 0.06.$$

Alternatively, the tow would have: an average UCE of >280 gcm/cm and an average fly of ≦0.030 g/30 min, or an average UCE of >265 and an average fly of ≦0.023, or an average UCE of >250 and an average fly of ≦0.017. Moreover, these tows would have an average Cv of <2.5 or 2.2 or 1.75. These tows would also have a firmness of 80 firmness units or more based on the Cerulean (formerly Filtrona) QTM-7. These tows would have a total denier in the range of 10,000-100,000 and a dpf in the range of 1.5-4 dpf.

UCE is the amount of work required to uncrimp a fiber. UCE, as reported hereinafter, is sampled prior to baling, i.e., post-drying and pre-baling. UCE, as used herein, is measured as follows: using a warmed up (20 minutes before conventional calibration) Instron tensile tester (Model 1130, crosshead gears—Gear #'s R1940-1 and R940-2, Instron Series IX-Version 6 data acquisition & analysis software, Instron 50 Kg maximum capacity load cell, Instron top roller assembly, 1"×4"×⅛" thick high grade Buna-N 70 Shore A durometer rubber grip faces), a preconditioned tow sample (preconditioned for 24 hours at 22° C.±2° C. and Relative humidity at 60%±2%) of about 76 cm in length is looped over and spread evenly across the center of the top roller, pre-tensioned by gently pulling to 100 g±2 g (per readout display), and each end of the sample is clamped (at the highest available pressure, but not exceeding the manufacturers recommendations) in the lower grips to effect a 50 cm gauge length (gauge length measured from top of the robber grips), and then tested, until break, at a crosshead speed of 30 cm/minute. This test is repeated until three acceptable tests are obtained and the average of the three data points from these tests is reported. Energy (E) limits are between 0.220 Kg and 10.0 Kg. Displacement (D) has a preset point of 10.0 Kg. UCE is calculated by the formula:

$$\text{UCE (gcm/cm)} = (E*1000)/((D*2)+500).$$

Further, the values used herein are average UCE. Average UCE refers to the average of at least thirty-five bales of tow, which represents the ability to detect a 10 UCE difference between samples at 95% confidence with existing variability.

Fly is small broken filaments in cigarette tow. Fly, as used herein, is measured as follows: fly is collected on a board made of flat black formica, 29.5 cm×68.5 cm, placed between and centered under the threaded rolls of a Hauni AF-2 opening unit, tow is run through a clean (no-fly) Hauni AF-2/KDF-2 rodmaker (set up: rodmaker speed—400 m/min (5% tolerance), threaded roll ratio—1.5:1, threaded roll pressure—2.5 Bars, Pre-tension pressure—Type A—1.0 Bar) for 10 minutes, after the 10 minutes, using a tared (to the nearest milligram) masking tape (approximately 6.5 cm-7.5 cm in length mounted on a cylinder, adhesive side out) pick up all fly from the board, then determine the fly-laden tape weight. Fly is calculated using the following formula:

$$\text{Fly (g/30 min)} = (G-T)*3$$

G=gross weight of fly-laden tape

T=tare weight of tape.

Further, the values used herein are average Fly. Average Fly refers to the average of at least one-hundred bales of tow, which represents the ability to detect a 0.01 g/30 min difference between samples at 95% confidence with existing variability.

Pressure drop is the difference in pressure between the ends of the filter rod as air is drawn through the rod at a flow rate of 17.5 cc/second. Pressure drop (and rod-to-rod pressure drop Cv), as used herein, is measured as follows: using a Quality Test Module (QTM-6) for pressure drop from Cerulean of Richmond, Va., USA with encapsulating tubing—latex, amber 5/16" ID×0.015" wall thickness, 35±5 durometer, calibrated with a certified 1.0 g weight and Cerulean standards for circumference rods and glass, the QTM is set up with air pressure—50 psi, flow rate—targeted for 17.7 cc/sec, encapsulation tubing—5/16" ID×0.015" (157 mm length (8% stretch)) and lf=on, cr=on, stop2=off, parity=off, baud=9600, Pd settle=0, inches=off, Pd=on, shape=off, roundness=off, ova=off, size-laser=on, suspend=off, wt=on, QTM ld=0, auto cal=off, protocal=0 (or 1, if HOST=on), host=off (or on for LIMS or PC connection), sw2 ident=2, sw1 ident=1, batch size=0, cofv=on, statistics=on, results=on, language=GB, printer=on, 30 preconditioned (preconditioning for 48 hours, at 22° C.±2° C., relative humidity—60%±2%) rods are tested and values of pressured drop and Cv are reported. Further, the values used herein are average Cv. Average Cv refers to the average of at least four-hundred bales of tow, which represents the ability to detect a 15% change in variance at 95% confidence.

Firmness (or hardness) refers to the deformation of a filter rod under pressure. Firmness is reported as % of retained diameter under load, and is sometimes referred to as firmness units.

$$\text{Firmness \%} = \frac{\text{original diameter} - \text{depression}}{\text{original diameter}} \times 100$$

Firmness reported herein was measured on a QTM-7, with factory settings, from Cerulean of Richmond, Va.

The present invention may be embodied in other forms without departing from the spirit and the essential attributes thereof, and, accordingly, reference should be made to the appended claims, rather than to the foregoing specification, as indicated the scope of the invention.

We claim:

1. A process for making a cellulose acetate tow comprising the steps of:

spinning a dope comprising a solution of cellulose acetate and solvent, taking-up the as-spun cellulose acetate filaments, lubricating the cellulose acetate filaments, forming a tow from the cellulose acetate filaments, plasticizing the tow with a plasticizer consisting of water, crimping the tow after plasticizing the tow, drying the crimped tow, and baling the dried crimped tow.

2. The process of claim 1 wherein the water being demineralized water.

3. The process of claim 1 wherein plasticizing the tow being preformed at least one half meter before the tow enters a crimper.

4. The process of claim 1 wherein plasticizing the tow being preformed at least one meter before the tow enters a crimper.

5. The process of claim 1 wherein plasticizing the tow further comprises an application rate of less than 300 cc/mm at line speeds of 200-1,000 meters per minute for a tow of 10,000 to 100,000 total denier.

6. The process of claim 1 wherein plasticizing the tow further comprises an application rate ranging from 25 to 200 cc/mm at line speeds of 200 - 1,000 meters per minute for a tow of 10,000 to 100,000 total denier.

7. The process of claim 1 wherein plasticizing the tow further comprising using a spool-type guide.

8. The process of claim 1 wherein plasticizing the tow further comprising using a pair of spool-type guides.

9. The process of claims 7 or 8 wherein the spool-type guide having a hole through which a plasticizer is dispensed.

10. The process of claims 7 or 8 wherein the spool-type guide having a tow contacting surface being flat or curved.

11. The process of claim 10 wherein the curved surface being concave, convex, wavy, or concaved/convexed.

12. The process of claims 7 or 8 wherein the spool-type guide being flanged or flangeless.

13. The process of claims 7 or 8 wherein the spool-type guide being ceramic or ceramic coated.

* * * * *